US011427375B2

(12) United States Patent
Hariharan et al.

(10) Patent No.: US 11,427,375 B2
(45) Date of Patent: Aug. 30, 2022

(54) CROSS-BRACE ASSEMBLY AND METHOD OF ASSEMBLING AND USE

(71) Applicant: WHIRLPOOL CORPORATION, Benton Harbor, MI (US)

(72) Inventors: Homprakash Hariharan, Pune (IN); Jayakumar Jayabal, Pune (IN); Sadasivam Narayanan, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 193 days.

(21) Appl. No.: 16/814,102

(22) Filed: Mar. 10, 2020

(65) Prior Publication Data

US 2021/0284380 A1 Sep. 16, 2021

(51) Int. Cl.
*B65D 5/44* (2006.01)

(52) U.S. Cl.
CPC ..... *B65D 5/445* (2013.01)

(58) Field of Classification Search
CPC ..... B65D 5/445; B65D 5/446; B65D 5/448; B65D 85/185
USPC ..... 206/320
See application file for complete search history.

(56) References Cited

U.S. PATENT DOCUMENTS

| | | | | |
|---|---|---|---|---|
| 3,493,101 A | | 2/1970 | Collin | |
| 4,314,633 A | * | 2/1982 | Oliff | B65D 71/00 206/148 |
| 5,669,496 A | | 9/1997 | Daniels | |
| 5,813,566 A | * | 9/1998 | Bradford | B65D 19/18 206/298 |
| 6,186,330 B1 | * | 2/2001 | Yoshimura | B65D 5/5071 206/594 |
| 6,749,108 B2 | | 6/2004 | Naughton et al. | |
| 7,413,111 B2 | * | 8/2008 | Quaintance | B65D 5/0015 220/651 |
| 8,413,836 B2 | | 4/2013 | Senn et al. | |
| 9,670,611 B2 | | 6/2017 | Senn et al. | |
| 10,136,792 B2 | | 11/2018 | Bak et al. | |

FOREIGN PATENT DOCUMENTS

| | | |
|---|---|---|
| EP | 2781463 B1 | 9/2016 |
| JP | H02296680 | 12/1990 |
| KR | 20080021388 A | 3/2008 |

* cited by examiner

*Primary Examiner* — Andrew D Perreault
(74) *Attorney, Agent, or Firm* — Price Heneveld LLP

(57) ABSTRACT

A cross-brace assembly for a package for a household appliance and method of assembling are provided. The cross-brace assembly can include a holder having a body having opposing first and second sides. The body includes first and second inner tabs that include first and second apertures, respectively. A first outer tab projects from the first side of the body, adjacent to the first inner tab, and a second outer tab projects from the second side of the body, adjacent to the second inner tab. A brace having opposing first and second ends can be received within the first and second apertures such that the first end of the brace is disposed adjacent the first outer tab and the second end of the brace is disposed adjacent the second outer tab to retain the brace relative to the holder.

12 Claims, 8 Drawing Sheets

CROSS-BRACE ASSEMBLY AND METHOD OF ASSEMBLING AND USE

FIELD OF THE DISCLOSURE

The present disclosure generally relates to a cross-brace assembly and method of assembling, and more specifically to a cross-brace assembly for use in packaging a household appliance.

BACKGROUND

Household appliances, such as ovens, refrigerators, and laundry treating appliances, for example, are often shipped in packaging that provides protection to the appliance during transport and storage. Clamp trucks are often used to move appliances during shipping, which can apply a lateral clamping force to the appliance package that may damage the appliance. As a result, appliance packages often include reinforcements and/or filler components to help protect the appliance from damage. For example, a cross-brace can be placed within the appliance package to reinforce the package and decrease the transfer of potentially damaging lateral forces to the appliance.

However, conventional cross-brace assemblies can include multiple components that need to be assembled and coupled together. For example, one type of conventional cross-brace assembly includes a cardboard holder that is folded multiple times and secured with multiple pieces of tape in order to form a sleeve for securing a cross-brace within an appliance package. This type of cross-brace assembly can be time-consuming to assemble and in some cases may require multiple operators to assemble.

SUMMARY

According to an aspect of the present disclosure, a package for a household appliance includes a container having a first wall and a second wall, opposite the first wall, and a cross-brace assembly. The cross-brace assembly includes a holder having a body with a first side and a second side, opposite the first side, and a first inner tab and a second inner tab, spaced from the first inner tab, wherein the first and second inner tabs project from the body. The first inner tab includes a first aperture and the second inner tab includes a second aperture. A first outer tab projects from the first side of the body, adjacent to the first inner tab, and a second outer tab projects from the second side of the body, adjacent to the second inner tab. A brace having opposing first and second ends is received within the first and second apertures such that the first end of the brace is disposed adjacent the first outer tab and the second end of the brace is disposed adjacent the second outer tab to retain the brace relative to the holder.

According to an aspect of the present disclosure, a cross-brace assembly includes a holder having a body comprising a first side and a second side, opposite the first side, and a first inner tab and a second inner tab, spaced from the first inner tab, wherein the first and second inner tabs are formed in the body, and wherein the first inner tab includes a first aperture and the second inner tab includes a second aperture. A first outer tab projects from the first side of the body, adjacent to the first inner tab and a second outer tab projects from the second side of the body, adjacent to the second inner tab. The first and second inner tabs are configured to be moveable into a position in which the first and second inner tabs extend at an angle relative to the body, and wherein the first and second apertures are configured to receive a brace therein to retain the brace between the first and second outer tabs.

According to another aspect of the present disclosure, a method of assembling a cross-brace assembly is provided. The method includes providing a holder having a body including a first side, spaced from a second side, and a first outer tab extending from the first side and a second outer tab extending from the second side. The method also includes bending a first inner tab and a second inner tab formed in the body, wherein the first inner tab is spaced from the first outer tab and the second inner tab is spaced from the second outer tab, and wherein the first inner tab includes a first aperture and the second inner tab includes a second aperture. The method includes inserting a brace through the first and second apertures, such that a first end of the brace is disposed between the first inner and outer tabs and the second end of the brace is disposed between the second inner and outer tabs and bending the first outer tab toward the first end of the brace and bending the second outer tab toward the second end of the brace.

These and other aspects, objects, and features of the present disclosure will be understood and appreciated by those skilled in the art upon studying the following specification, claims, and appended drawings.

DETAILED DESCRIPTION

Figure 1:
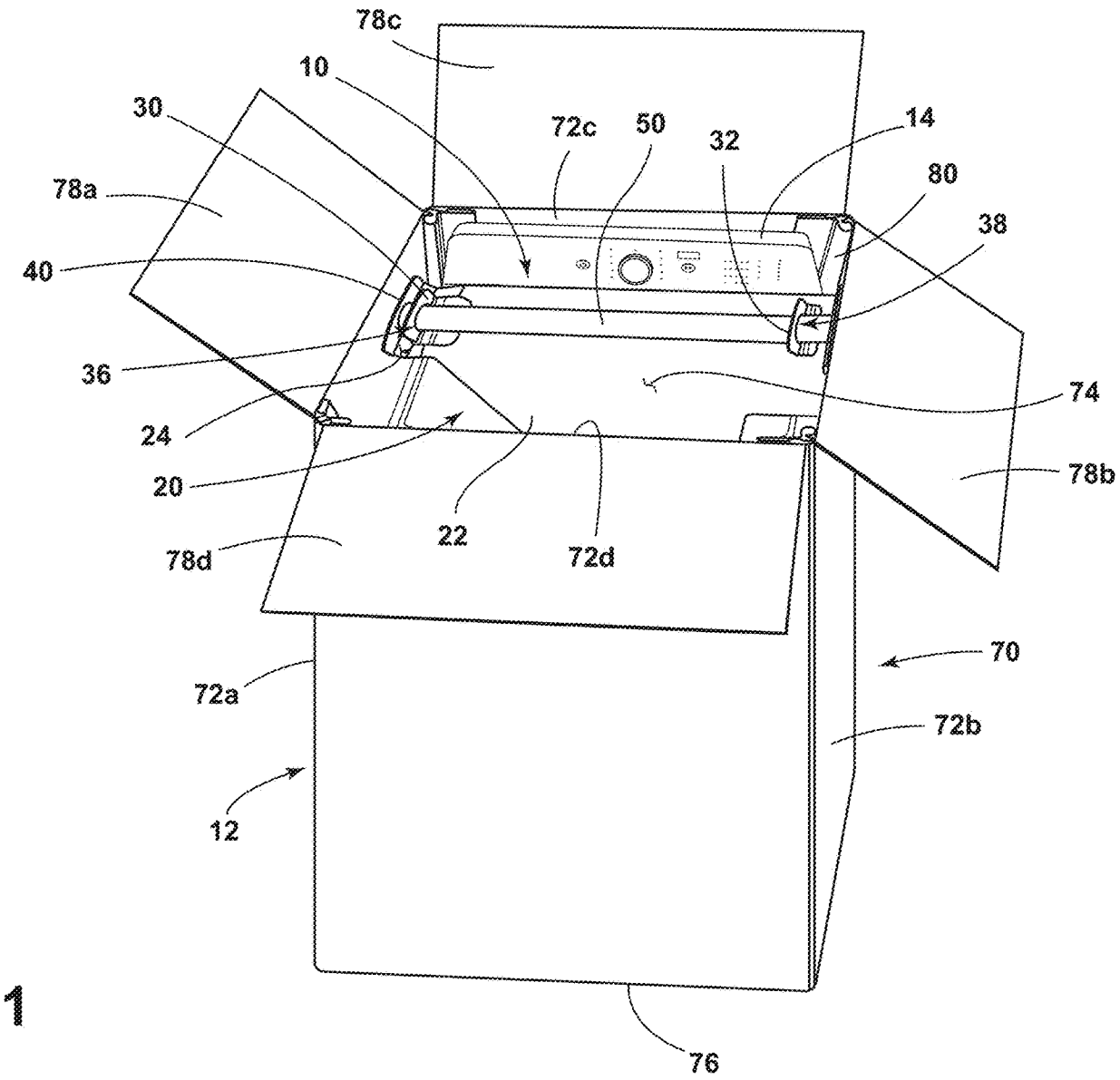
FIG. 1 is a perspective view of a package for a household appliance including a household appliance and a cross-brace assembly, according to an aspect of the present disclosure.

For purposes of the description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of apparatus components and method steps relating to a cross-brace assembly for a household appliance package and a method of assembling and use of a cross-brace assembly for a household appliance package. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIGS. 1-8 generally relate to a cross-brace assembly 10 for a package 12 for a household appliance 14. The cross-brace assembly 10 can include a holder 20 having a body 22 including a first side 24 and a second side 26, opposite the first side 24. The holder 20 includes a first inner tab 30 and a second inner tab 32, spaced from the first inner tab 30, wherein the first and second inner tabs 30, 32 project from the body 22, and wherein the first inner tab 30 includes a first aperture 36 and the second inner tab 32 includes a second aperture 38. A first outer tab 40 projects from the first side 24 of the body 22, adjacent to the first inner tab 30, and a second outer tab 42 projects from the second side 26 of the body 22, adjacent to the second inner tab 32. A brace 50 having opposing first and second ends 52, 54 can be received within the first and second apertures 36, 38, respectively, such that the first end 52 of the brace 50 is disposed adjacent the first outer tab 40 and the second end 54 of the brace 50 is disposed adjacent the second outer tab 42 to retain the brace 50 relative to the holder 20.

The cross-brace assembly 10 can be used with the package 12 of a household appliance 14 to provide resistance to lateral forces that may be applied to the package 12 during shipping of the household appliance 14. The package 12 can include a container 70 having at least first and second opposing side walls 72*a* and 72*b* which at least partially define a cavity 74 for housing the household appliance 14 therein. Aspects of the present disclosure are not limited to the specific details of the container 70, but may be used with any type of container suitable for shipping a household appliance or other type of goods. In some examples, the cross-brace assembly 10 can be configured to provide resistance to lateral forces that may be applied to the package 12 when a single package 12 is clamped during shipping/transport and/or when multiple packages 12 are clamped together during shipping/transport.

In one example, the container 70 is in the form of a conventional box that includes first, second, third, and fourth side walls 72*a-d* that are folded relative to one another and secured using mechanical and/or non-mechanical fasteners. The container 70 can optionally include a bottom wall 76 that is integrally formed with one of the side walls 72*a-d* or which is formed separately (e.g., a shipping pallet). The container 70 can optionally include a cover that may be integrally formed with at least one of the side walls 72*a-d* or formed separately. In the exemplary embodiment of FIGS. 1-2, the container 70 includes a cover in the form of multiple cover flaps 78*a-d* which can be folded inward to close an upper opening of the container 70. The side walls 72*a-d*, optional bottom wall 76, and cover 78*a-d* can be made from any suitable type of material or combination of materials, non-limiting examples of which include cardboard, wood, and polymeric materials. The package 12 can optionally include additional reinforcements and/or protective components known in the art, non-limiting examples of which include corner braces 80 and packing filler (not shown).

Figure 2:
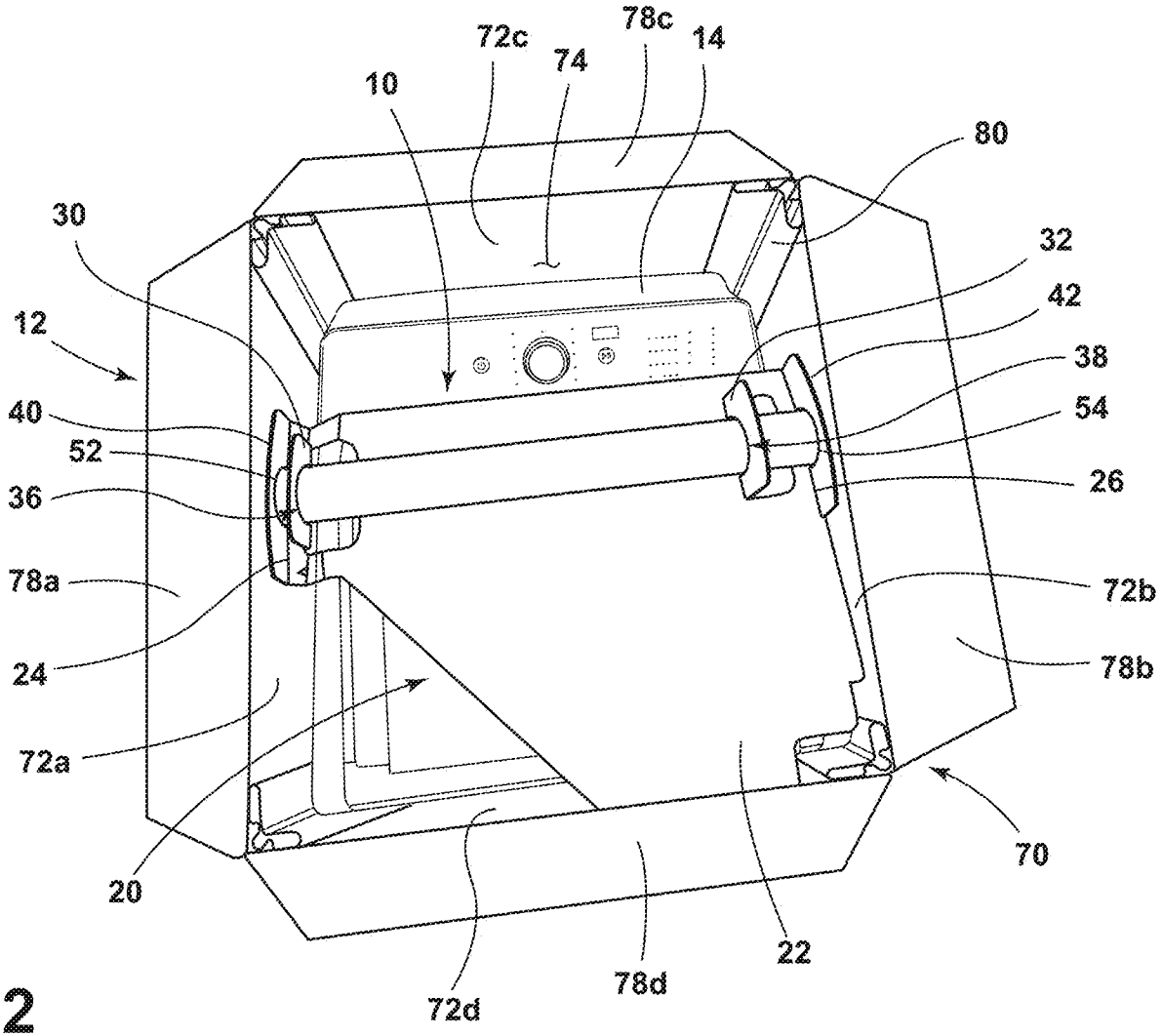
FIG. 2 is a top-down view of the package for a household appliance of FIG. 1.

The household appliance 14 is illustrated as a laundry treating appliance, but aspects of the present disclosure can be utilized with any suitable type of household appliance, non-limiting examples of which include laundry treating appliances, clothes washing machines, clothes dryers, combination washer/dryers, dishwashers, ovens, ranges, microwave ovens, refrigerators, freezers, and televisions. While a single household appliance 14 is illustrated in the package 12, it is understood that the package 12 may include multiple household appliances 14 in a vertically or horizontally stacked configuration. Further, while only a single cross-brace assembly 10 is illustrated, it is understood that multiple cross-brace assemblies 10 can be utilized with the package 12 in a stacked configuration. For example, a cross-brace assembly 10 may be used near a bottom of the package 12, near a top of the package 12 (as illustrated in FIGS. 1 and 2), and/or spaced vertically between the top and bottom of the package 12. For example, in a configuration in which the package 12 includes multiple, vertically stacked household appliances, a cross-brace assembly 10 may be disposed above the top-most appliance, below the bottom-most appliance, and/or between one or more of the vertically stacked household appliances. While the cross-brace assembly 10 is illustrated in FIGS. 1-2 as having an orientation in which the brace 50 is facing upward, away from the appliance 14, it is within the scope of the present disclosure for the cross-brace assembly 10 to be utilized in an inverted orientation. For example, based on the configuration of the appliance 14, utilization of the cross-brace assembly 10 in an inverted orientation (relative to the orientation shown in FIGS. 1-2) may facilitate placement of and/or bracing by the cross-brace assembly 10.

Figure 3:
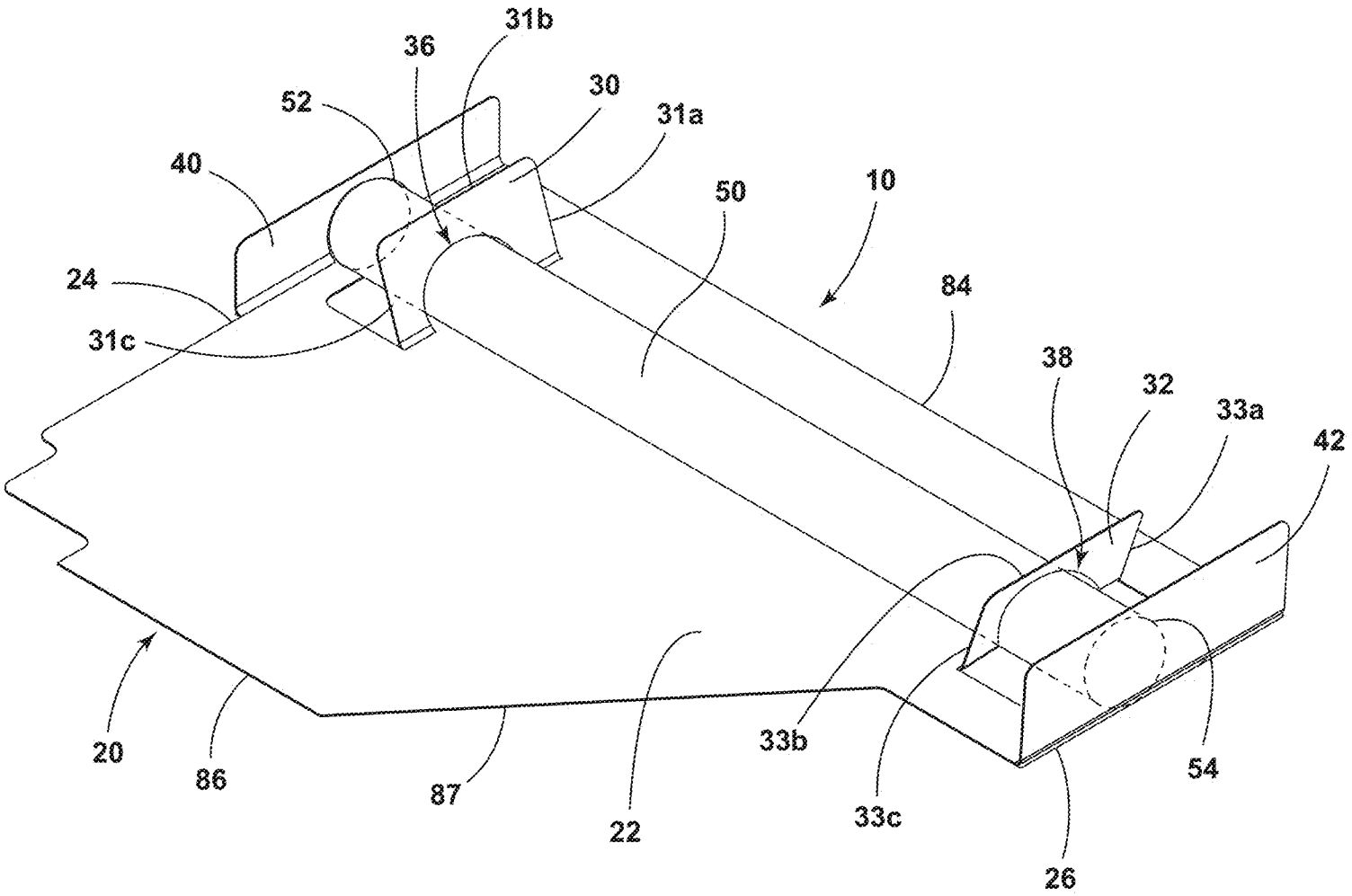
FIG. 3 is a perspective view of a cross-brace assembly, according to an aspect of the present disclosure.
Figure 4:
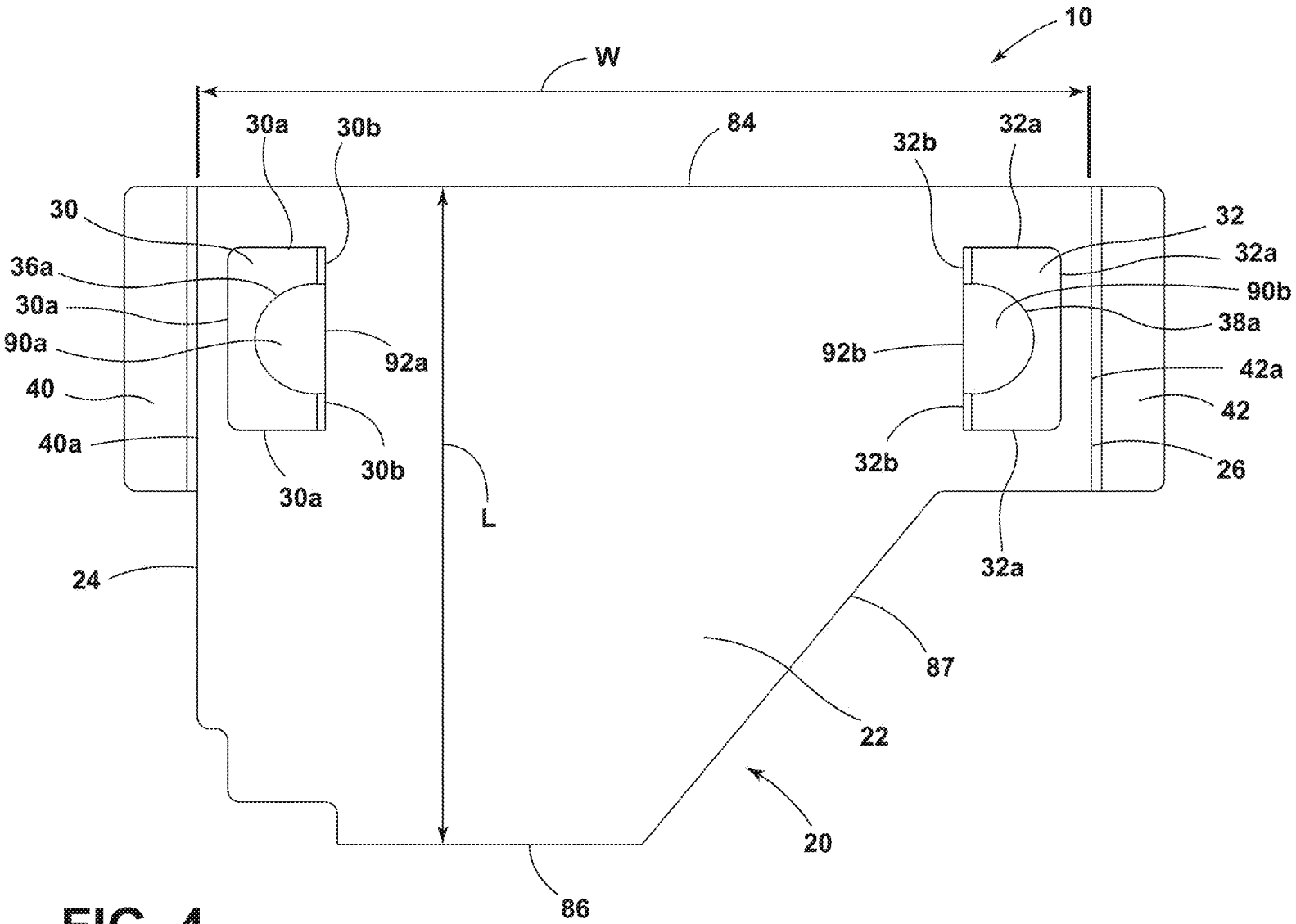
FIG. 4 is a top-down view of a holder of a cross-brace assembly in a pre-assembled condition, i.e. a condition prior to assembly, according to an aspect of the present disclosure.
Figure 5:
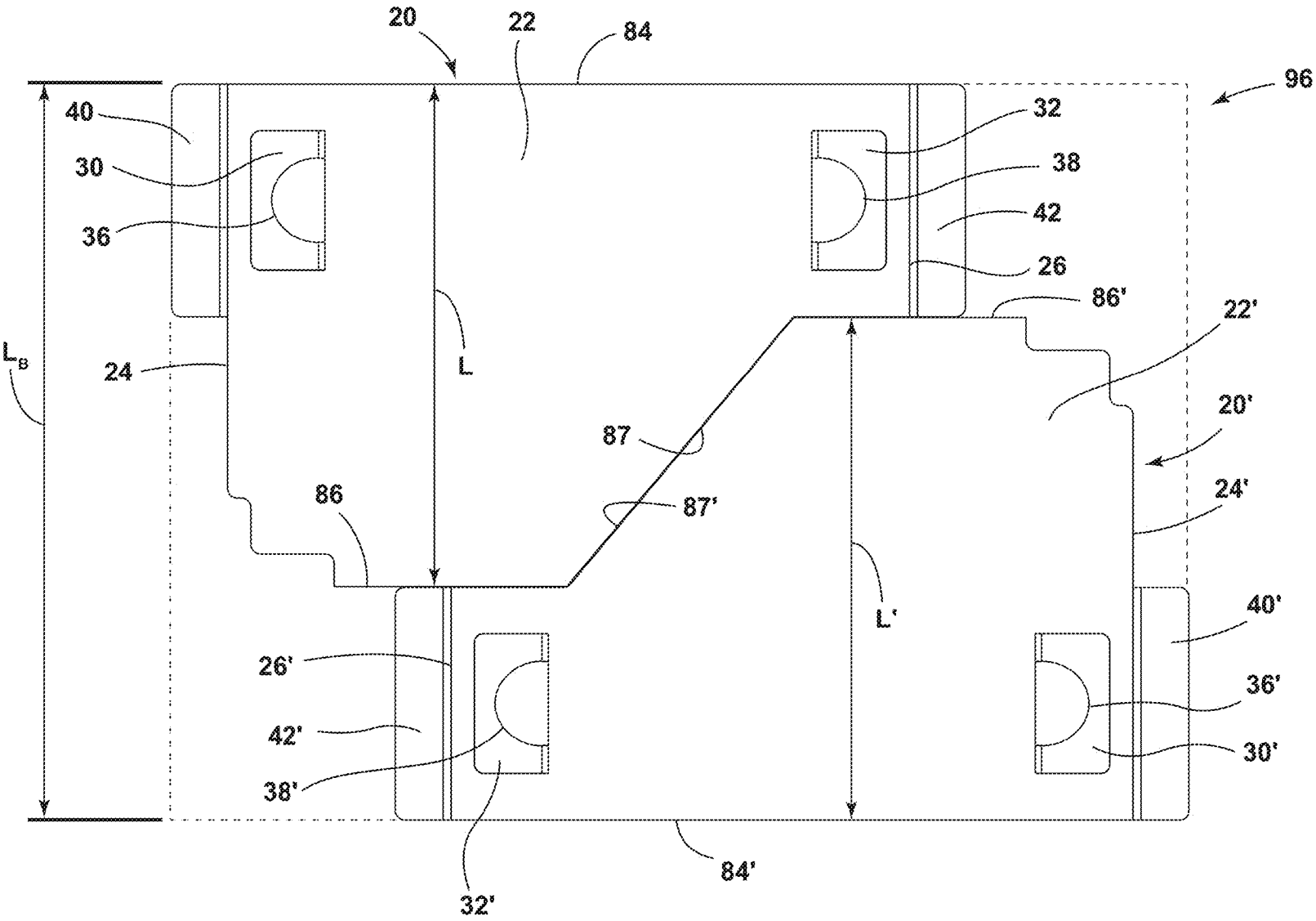
FIG. 5 is a top-down view of a blank used to form a cross-brace assembly, according to an aspect of the present disclosure.

Referring now to FIGS. 3-5, the body 22 of the holder 20 of the cross-brace assembly 10 includes first and second sides 24 and 26, which generally define a width W of the cross-brace assembly 10. The width W of the cross-brace assembly 10 can be selected to generally correspond to a distance between the opposing first and second walls 72*a-b* of the container 70 that the cross-brace assembly 10 is intended to brace. The width W of the body 22 may be selected to provide a desired level of tolerance between the width W of the body 22 and the space within which the holder 20 is intended to be positioned. The first and second outer tabs 40 and 42 can project from the first and second sides 24 and 26, respectively. The first and second outer tabs 40 and 42 can be integrally formed with the body 22 or may be separately formed and attached to the body 22 using one or more mechanical and/or non-mechanical fasteners. Non-limiting examples of suitable fasteners include clamps, clips, tape, staples, and adhesives.

The body 22 also includes a third side 84 and an opposing fourth side 86 extending between the first and second sides 24, 26. The fourth side 86 can define an irregular edge between the first and second sides 24, 26 (as illustrated) or can define a generally straight edge between the first and second sides 24, 26. The body 22 can have a length L defined as the maximum distance between third and fourth sides 84, 86 of the body 22. The length L of the body 22 can be selected at least in part to facilitate restricting movement of the holder 20 relative to the container 70. In some examples, the length L of the body 22 may generally correspond to a distance between the third and fourth walls 72*c-d* of the container 70. In another example, such as that illustrated in FIGS. 1-2, the length L of the body may generally correspond to a distance between a portion of the household appliance 14 (such as a control console) and the opposing wall 72*d*. The length L of the body 22 may be selected to provide a desired level of tolerance between the length L of the body 22 and the space within which the cross-brace assembly 10 is intended to be positioned.

According to one aspect, the fourth side 86 can include an angled edge portion 87 that facilitates nesting of the body 22 and an adjacent body 22', as illustrated in the embodiment of FIG. 5. Nesting of the body 22 and an adjacent body 22' can facilitate consuming less materials during production. Nesting of the body 22 with an adjacent body 22' may also facilitate use of multiple, nested cross-brace assemblies 10 in a package in scenarios in which it is desired to use more than one cross-brace assembly 10 to brace a package.

The first and second inner tabs 30, 32 are formed in the body 22 and are configured to be moveable into a position in which they extend at an angle relative to a horizontal plane defined by body 22. In one example, the first and second inner tabs 30, 32 are cut, stamped, and/or punched from the body 22 to at least partially separate the first and second inner tabs 30, 32 from the body 22 such that the first and second inner tabs 30, 32 can be bent relative the horizontal plane defined by at least the portions of the body 22 adjacent the first and second inner tabs 30, 32. In this manner, the first and second inner tabs 30, 32 can be integrally formed with the body 22 of the holder 20. The first inner tab 30 can be defined at least in part by tab edges 31*a-c* and the second inner tab 32 can be defined at least in part by tab edges 33*a-c*. Each of the first and second inner tabs 30 and 32 can include an aperture 36 and 38, respectively, formed therein. The apertures 36 and 38 can be cut, stamped, and/or punched from the body 22 in the area of the body 22 corresponding to the respective first and second inner tabs 30, 32. The apertures 36, 38 are configured to have sufficient dimensions to allow the brace 50 to be inserted and retained therein such that the first and second inner tabs 30, 32 retain the brace 50 relative to the holder 20. In some aspects, the dimensions of the first and second inner tabs 30, 32 are selected at least in part based on the dimensions of the brace 50.

The cross-sectional shape of the first and second apertures 36, 38 can be selected at least in part based on the cross-sectional shape of the brace 50. In some examples, the first and second apertures 36, 38 can have a cross-sectional shape that is generally similar to the brace 50. In other examples, the cross-sectional shape of the first and second apertures 36, 38 is different than that of the brace 50. For example, in the exemplary embodiment of FIGS. 1-3, the brace 50 has a circular cross-sectional shape and the first and second apertures 36, 38 have a semi-circular cross-sectional shape that generally reflects the circular cross-sectional shape of the brace 50. Non-limiting examples of cross-sectional shapes of the brace 50 and the first and second apertures 36, 38 include circular, semi-circular, rectangular, square, triangular, hexagonal, or any other regular or irregular geometric shape. The relative dimensions of the brace 50 and the first and second apertures 36, 38 can be selected to provide the desired degree of tolerance between the brace 50 and the first and second apertures 36, 38.

The body 22 can be formed from any suitable material, examples of which include cardboard, polymeric material, card stock, paper, and combinations thereof. In one aspect, the body 22 is formed from a sheet of corrugated material, such as corrugated cardboard or corrugated polypropylene. For example, the body 22 can be formed from a sheet of B-Flute or C-Flute corrugated material, such as cardboard. In one example, the body 22 can be formed from a B-Flute corrugated material having a thickness of about 3 mm. In another example, the body 22 can be formed from a C-Flute corrugated material having a thickness of about 4 mm. The type of material selected to form the body 22 can be based at least in part on the desired stiffness and/or strength of the material and its intended use. The first and second outer tabs 40, 42 can be formed from the same or different material than the body 22.

The dimensions and the type of material used to form the brace 50 can be selected at least in part on a desired strength and/or the intended use of the cross-brace assembly 10. Non-limiting examples of suitable types of material for forming the brace 50 include aluminum, metal, metal alloys, wood, polymeric materials, cardboard, corrugated material, and combinations thereof. In one example, a length of the brace 50 is selected at least in part based on the width of the package to be braced. For example, with respect to the exemplary embodiment of FIGS. 1-2, the length of the brace 50 can be selected at least in part based on a distance between the opposing first and second walls 72*a-b* of the container 70. In one example, the length of the brace 50 can generally correspond to the width W of the body 22 of the holder 20. For a typical U.S. clothes washing machine, an exemplary brace 50 would typically have a length of from about 715 mm to about 745 mm. However, it is understood that the length can vary depending on factors including the dimensions of the appliance and associated packaging material.

Referring now to FIGS. 4-5, the holder 20 of the cross-brace assembly 10 can be formed using any suitable method based at least in part on the materials used to form the holder 20. In some aspects, the holder 20 is cut, stamped, or punched from a sheet of material. Referring to FIG. 4, the first and second inner tabs 30, 32 can be formed in the body 22 by cutting, stamping, or punching the body 22 such that each of the first and second inner tabs 30, 32 is at least partially separated from the body 22 along a separation line 30*a*, 32*a*, but remains attached to the body 22 along an edge 30*b*, 32*b*, respectively. The separation lines 30*a* and 32*a* generally correspond to the tab edges 31*a-c* and 33*a-c*, respectively, such that separation of portions of the body 22 along the separation lines 30*a* and 32*a* provides the first and second inner tabs 30, 32 defined by tab edges 31*a-c* and 33*a-c*, respectively. In some aspects, the edge 30*b*, 32*b* may correspond to hinge axis of a living hinge and thus in some embodiments, the edges 30*b*, 32*b* may be referred to as living hinges 30*b*, 32*b*. In some examples, the separation line 30*a*, 32*a* completely separates the first and second inner tabs 30, 32 from the body 22, thereby allowing the first and second inner tabs 30, 32 to be folded or bent along edge 30*b*, 32*b* during assembly of the cross-brace assembly 10. In other examples, the separation line 30*a*, 32*a* may only partially separate the first and second inner tabs 30, 32 from the body 22 such that an additional force is required to separate the first and second inner tabs 30, 32 from the body 22 along the separation lines 30*a*, 32*a* to thereby allow the first and second inner tabs 30, 32 to be folded or bent along edge 30*b*, 32*b* relative to the body 22. For example, the separation lines 30*a*, 32*a* may include a plurality of perforations or a line of weakness. The first and second inner tabs 30, 32 can then be bent or folded along the edge 30*b*, 32*b* relative to the body 22 by first applying a force to separate the first and second inner tabs 30, 32 along the separation line 30*a*, 32*a*. Optionally, the edge 30*b*, 32*b* may be formed by a fold line that is formed in the body 22 before, after, or during formation of the separation lines 30*a*, 32*a*. The fold line can be provided by forming a crease line and/or a score line in the material in the desired location to facilitate bending or folding of the first and second inner tabs 30, 32 along the respective edges 30*b*, 32*b*. In this manner, the first and second inner tabs 30, 32 can each be provided with a living hinge having a hinge axis that generally corresponds to the edge 30*b*, 32*b*, respectively, about which the first and second inner tabs 30, 32 can be bent.

In some aspects, a width of the edges 30*b*, 32*b* can be selected at least in part to provide the first and second inner tabs 30, 32 with a desired strength. In some examples, the width of the edges 30*b*, 32*b* may be based at least in part on the material used to form the body 22. In some examples, the width of the edges 30*b*, 32*b* may be selected at least in part to provide the first and second inner tabs 30, 32 with a desired strength to resist tearing during bending of the first and second inner tabs 30, 32, insertion of the brace 50, and/or during use of the cross-brace assembly 10 with an appliance 14 during shipment and/or storage. In some examples, the width of the edges 30*b*, 32*b*, can be based at least in part in providing the first and second inner tabs 30, 32 with a desired durability to allow for re-use of the cross-brace assembly 10.

The first and second apertures 36, 38 can be formed by cutting, stamping, or punching a portion 90*a*, 90*b* of the first and second inner tabs 30, 32, along at least a first line of separation 36*a*, 38*a*, respectively. In some examples, the portions 90*a*, 90*b* can remain attached to the body 22 along an edge 92*a*, 92*b*, respectively. Optionally, the portions 90*a*, 90*b* can be separated from the body 22 along the edge 92*a*, 92*b* such that the portions 90*a*, 90*b* are completely separated from the body 22 when forming the apertures 36, 38, respectively. In some examples, the first line of separation 36*a*, 38*a* completely separates the portions 90*a*, 90*b* from the body 22, thereby allowing the portions 90*a*, 90*b* to be folded or bent along the edge 92*a*, 92*b* during assembly of the cross-brace assembly 10. In some examples, the edge 92*a*, 92*b* can form a hinge axis of living hinge about which the portions 90*a*, 90*b*, respectively, can be bent. In other examples, the first line of separation 36*a*, 38*a* may only partially separate the portions 90*a*, 90*b* from the body 22 such that an additional force is required to separate the portions 90*a*, 90*b* from the body 22 along the first line of separation 36*a*, 38*a*. For example, the first line of separation 36*a*, 38*a* may include a plurality of perforations or a line of weakness which require an additional separation force to be applied in order to separate the portions 90*a*, 90*b* from the body 22 along the first line of separation 36*a*, 38*a*. When the portions 90*a*, 90*b* are configured to be completely removed from the body 22, the edge 92*a*, 92*b* can include a cut line that separates the portions 90*a*, 90*b* from the body 22 or a partial line of separation (such as a perforated line) that requires the application of an additional force to separate the portions 90*a*, 90*b* from the body 22 along the edge 92*a*, 92*b*.

In some aspects, at least one fold line is formed between the first and second outer tabs 40, 42 and the adjacent first and second sides 24, 26 of the body 22. The fold line can be provided by forming a crease line and/or a score line in the material in the desired location to facilitate bending or folding of the first and second outer tabs 40, 42 along the respective sides 24, 26.

FIG. 5 illustrates an exemplary blank 96 that multiple holders, such as a first holder 20 and a second holder 20', can be formed from. The blank 96 can be a sheet or roll of any suitable material for forming the cross-brace assembly 10 according to aspects of the present disclosure. The first and second holders 20, 20' can be cut, stamped, or punched from the blank 96 to separate the first and second holders 20, 20' from the blank 96. Any one or more of the separation lines and/or fold lines described above with respect to FIG. 4 for forming the first and second inner tabs 30, 32, the first and second apertures 36, 38, and/or the first and second outer tabs 40, 42 can be formed concomitantly or sequentially with forming the body 22, 22' of the holders 20, 20' in the blank 96.

The blank 96 can have a length $L_B$ that corresponds to an overlapped length L and L' of the first and second holders 20, 20', respectively. The full length $L_B$ of the blank 96 is used to provide the body 22, 22' each of the holders 20, 20' with the desired length across the width of the body 22, 22', with little to none of the length of the blank $L_B$ wasted. While the blank 96 is illustrated as forming two holders 20, 20', it is understood that the size of the blank 96 could be selected to form a single holder 20 or to form more than two holders 20, 20', etc. In some examples the blank 96 is a sheet of material having sufficient dimensions to form one, two, or more holders 20. In some examples the blank 96 may be a roll of material that can form the holders 20 in a continuous or semi-continuous process.

Figure 6:
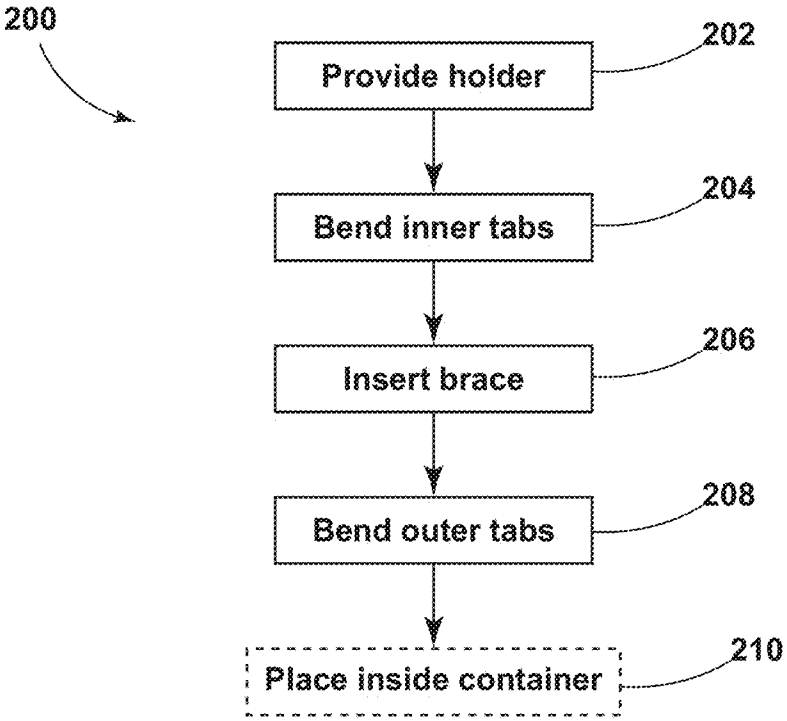
FIG. 6 is a flow chart illustrating a method of assembling a cross-brace assembly, according to an aspect of the present disclosure.
Figure 7:
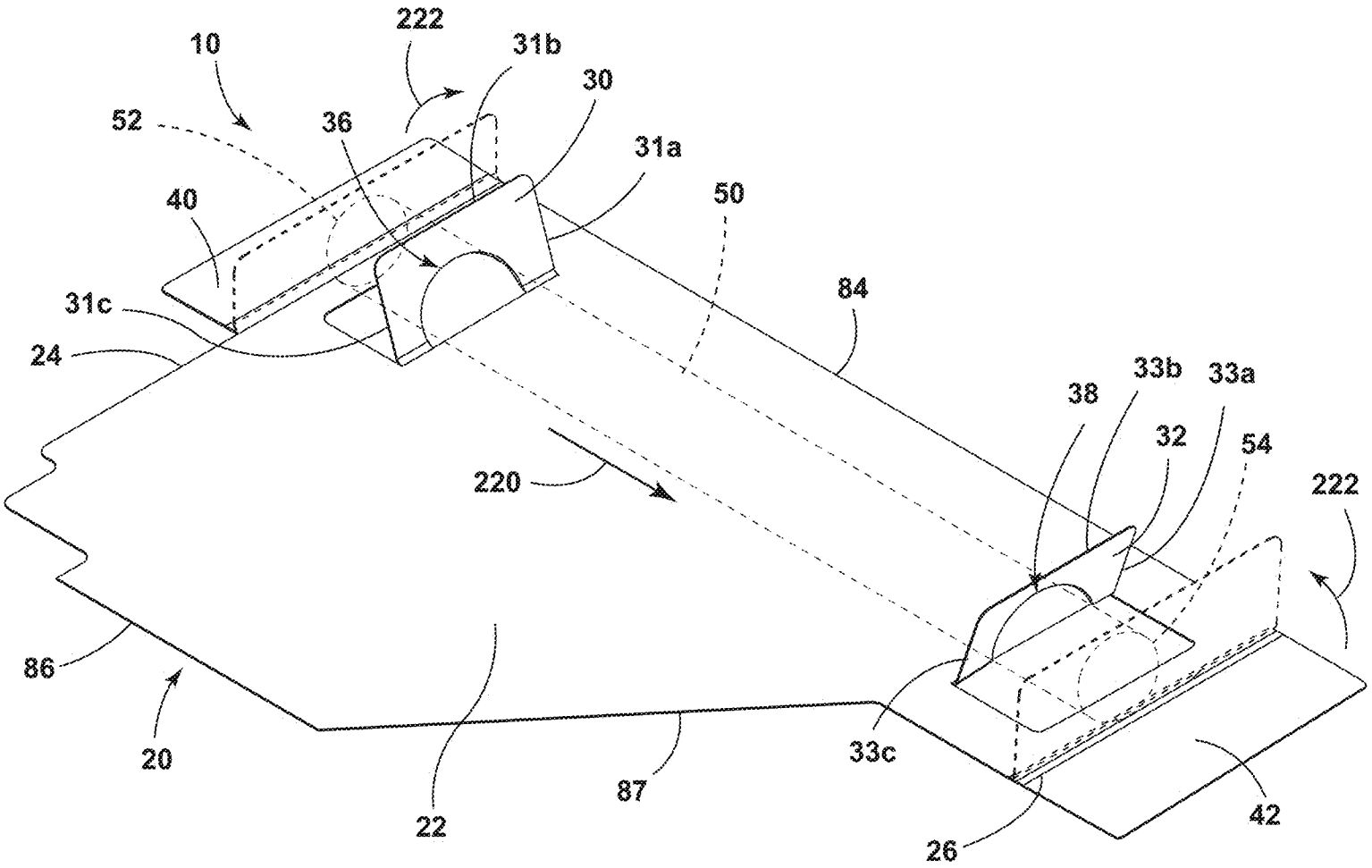
FIG. 7 is a schematic representation of a method of assembling a cross-brace assembly, according to an aspect of the present disclosure.

FIGS. 6 and 7 illustrate a method 200 of assembling a cross-brace assembly according to aspects of the present disclosure. While the method is described in the context of the cross-brace assembly 10 and household appliance package 12 of FIGS. 1-2, it is understood that the method 200 may be used in a similar manner with other cross-brace assemblies and/or household appliance packages. While the method 200 is discussed in the context of using a cross-brace assembly 10 that includes the holder 20 and the brace 50, it is within the scope of the present disclosure for the cross-brace assembly 10 to include the holder 20 in the absence of the brace 50.

Referring to FIGS. 4-6, the method 200 includes providing the holder 20 at step 202. The holder 20 can be formed according to any of the methods described herein, including with respect to FIGS. 4 and 5. At step 204, the first and second inner tabs 30, 32 of the holder 20 can be bent upward with respect to the body 22. In some examples, bending the first and second inner tabs 30, 32 causes the first and second inner tabs 30, 32 to separate from the portions 90*a*, 90*b*, respectively, (FIG. 4) which forms the first and second apertures 36, 38 in the first and second inner tabs 30, 32. In some examples, the portions 90*a*, 90*b* may be completely separated from the body 22 prior to bending the first and second inner tabs 30, 32. In other examples, the portions 90*a*, 90*b* may remain partially attached to the first and second inner tabs 30, 32, such that a user is required to apply an additional force to separate the portions 90*a*, 90*b* from the first and second inner tabs 30, 32 to form the first and second apertures 36, 38.

After bending the first and second inner tabs 30, 32 and forming the apertures 36, 38 at step 204, at step 206 the brace 50 can be inserted through one of the first and second apertures 36, 38, as illustrated by arrow 220 in FIG. 7, and slid relative to the body 22 until the brace 50 extends through both the first and second apertures 36, 38. The brace 50 can be slid relative to the body 22 until the first end 52 of the brace 50 is disposed between the first inner tab 30 and the first outer tab 40 and the second end 54 of the brace 50 is disposed between the second inner tab 32 and the second outer tab 42.

At step 208, the first and second outer tabs 40, 42 can be bent relative to the body 22 toward the first and second ends 52, 54 of the brace 50, respectively, as illustrated by arrows 222. Optionally, at 210, the assembled cross-brace assembly 10 can be inserted into position inside the container 70. In some examples, step 208 may occur prior to step 210 such that the first and second outer tabs 40, 42 are bent prior to placing the cross-brace assembly 10 inside the container 70. In other examples, steps 208 and 210 may occur generally concomitantly. For example, as the cross-brace assembly 10 is being inserted into the container 70, the first and second walls 72*a*, 72*b* can engage the first and second outer tabs 40, 42 and cause the first and second outer tabs 40, 42 to bend toward the brace 50 as the cross-brace assembly 10 is lowered into place within the container 70.

In some examples, the tolerances between the first and second walls 72*a*, 72*b*, the first and second outer tabs 40, 42, and the first and second ends 52, 54 of the brace 50 may be small such that when the household appliance package 12 is assembled, an outer surface of the first outer tab 40 abuts the first wall 72*a* and an inner surface of the first outer tab 40 abuts the first end 52 of the brace 50 and an outer surface of the second outer tab 42 abuts the second wall 72*b* and an inner surface of the outer tab 42 abuts the second end 54 of the brace 50. In some examples, one or more of the tolerances between the first and second walls 72*a*, 72*b*, the first and second outer tabs 40, 42, and the first and second ends 52, 54 of the brace 50 may be larger such that a space or gap may be provided between one or more adjacent components. For example, one or more of the tolerances between the first outer tab 40 and the first wall 72*a* and/or between the first outer tab 40 and the first end 52 of the brace 50 may be sufficiently large to allow for a permanent or intermittent gap to form between these components and/or to allow for greater variation in the dimensions of the container 70. In some examples, the tolerances may be such that the outer surfaces of the first and second outer tabs 40, 42 abut the adjacent first and second walls 72*a*, 72*b* and one or both of the first and second ends 52, 54 of the brace 50 may be spaced from the inner surface of the adjacent outer tab 40, 42.

The cross-brace assembly 10 described herein can provide several benefits compared to some conventional cross-brace assemblies. For example, the cross-brace assembly 10 of the present disclosure is configured to retain the brace 50 relative to the holder 20 without the use of adhesives, tape, or supplemental mechanical fasteners. Such a configuration can provide cost savings in terms of materials and/or in terms of reduced labor costs to assemble. One type of conventional cross-brace assembly includes folding multiple portions of a holder body to form a sleeve that contains the brace therein. Formation of the sleeve can be time consuming and may also require the use of tape, adhesives, and/or supplemental mechanical fasteners to secure the sleeve. In addition, providing sufficient material in the blank used to form the sleeve can result in increased blank material waste compared to the blank used to form the cross-brace assembly of the present disclosure. As described above with respect to FIG. 5, the holder 20 of the cross-brace assembly 10 of the present disclosure can be formed from a blank in which the full length of the blank is utilized to provide the body 22 of the holder 20 with a desired length along the width of the body 22, such that there is little to no waste in the length dimension of the blank, such as may result when the length of the blank is increased in order to provide material to form additional structures, such as a brace-holding sleeve.

Figure 8:
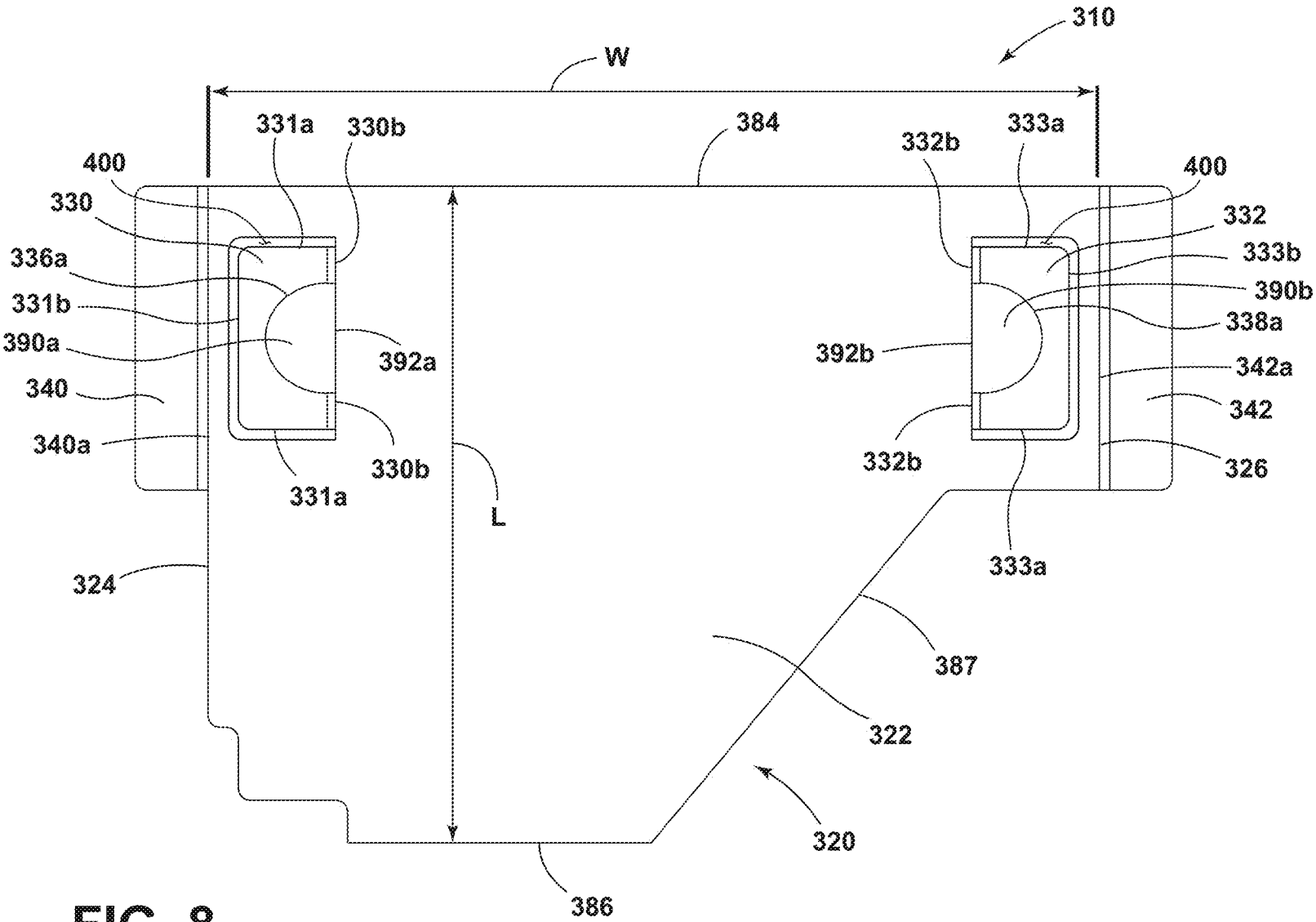
FIG. 8 is a top-down view of a holder of a cross-brace assembly in a pre-assembled condition, i.e. a condition prior to assembly, according to an aspect of the present disclosure.

FIG. 8 illustrates a cross-brace assembly 310 according to an aspect of the present disclosure that is similar to the cross-brace assembly 10 of FIGS. 1-5 in some aspects and different in others. Therefore, elements of the cross-brace assembly 310 similar to those of the cross-brace assembly 10 are labeled with the prefix 300.

Still referring to FIG. 8, the cross-brace assembly 310 can include an opening or relief cut-out 400 in the body 322 around at least a portion of a perimeter of the first and/or second inner tabs 330, 332. While aspects of the present disclosure are discussed in the context of openings 400 around at least a portion of a perimeter of the first and second inner tabs 330, 332, it is within the scope of the present disclosure for the opening 400 to be formed around only one of the first and second inner tabs 330, 332. When present around both the first and second inner tabs 330, 332, the shape and/or dimensions of each of the openings 400 may be the same or different.

The openings 400 can be configured to provide a space between the tab edges 331*a-c* and 333*a-c* of the first and second inner tabs 330, 332 and adjacent portions of the body 322 when the first and second inner tabs 330, 332 lie within substantially the same plane as the body 322. As used herein, the first and/or second inner tabs 330, 332 are considered to lie within substantially the same plane of the body 322 when the first and second inner tabs 330, 332 are within about ±10 degrees, about ±5 degrees, or about ±1 degree of the plane defined by at least the portions of the body 322 adjacent the first and second inner tabs 330, 332. The openings 400 can provide a gap or space that can facilitate bending of the first and second inner tabs 330, 332 relative to the body 322. In one example, the openings 400 can facilitate bending of the first and second inner tabs 330, 332 from a first position in which the first and second inner tabs 330, 332 lie within substantially the same plane as the body 322, and a second position in which the first and second inner tabs 330, 332 extend at a greater angle relative to the body 322. In another example, the openings 400 can facilitate bending the first and second inner tabs 330, 332 from a first position in which the first and second inner tabs 330, 332 extend at an angle relative to a first side of the body 322, through the plane defined by the body 322, and into a second position in which the first and second inner tabs 330, 332 extend at an angle relative to a second side of the body 322, opposite the first side of the body 322. In one aspect, the opening 400 can be provided between the body 322 and all of the tab edges 331*a-c* and 333*a-c*, as illustrated in FIG. 8. In another aspect, the openings 400 can be provided between only one or two of the tab edges 331*a-c* and 333*a-c*. For example, in some aspects, the openings 400 may be provided only between the tab edges 331*b* and 333*b* and adjacent portions of the body 322. The openings 400 may extend along an entirety of one or more of the tab edges 331*a-c* and 333*a-c* or along only a portion of one or more of the tab edges 331*a-c* and 333*a-c*.

Each of the openings 400 can have any desired shape and dimensions, with each of the openings 400 having the same or different shape and/or dimensions. In some aspects, the shape and/or dimensions of the opening 400 may be selected to facilitate insertion of a user's digit or tool into the opening 400 to facilitate movement of one of the first and second inner tabs 330, 332 relative to the body 322, such as by facilitating the ability of a user or tool to grasp an edge of the first or second inner tab 330, 332 in order to manipulate the first or second inner tab 330, 332. The dimensions of the openings 400 between one or more of each of the tab edges 331*a-c* and 333*a-c* and the body 322 may be the same (within machine tolerance values) or different.

The holder 320 can be formed according to any suitable method, including the method described above with respect to the holder 20. The openings 400 can be provided in the body 322 by stamping, cutting, and/or punching portions of the body 322 adjacent to the first and second inner tabs 330, 332 to provide each opening 400 around the first and second inner tabs 330, 332 with the desired dimensions and shape. In some aspects, the openings 400 around each of the first and second inner tabs 330, 332 can be formed at the same time as forming the first and second inner tabs 330, 332 in the body 322. For example, the first and second inner tabs 330, 332 can be formed in the body 322 using a stamp, cutting, or punching tool that is configured to provide a kerf that corresponds to the desired dimensions of the opening 400. In other words, the width of the cut made by the stamp, cutting, or punching tool can correspond to the desired width of the openings 400. In this manner, the process of separating the first and second inner tabs 330, 332 from the body 322 along the tab edges 331*a-c* and 333*a-c*, respectively, also provides the openings 400 around each of the first and second inner tabs 330, 332.

In another aspect, the openings 400 can be formed around the first and second inner tabs 330, 332, independently of the formation of the openings 400 around each of the first and second inner tabs 330, 332. For example, each of the first and second inner tabs 330, 332 can be formed in the body 322 by stamping, cutting, or punching, as described above with respect to the holder 20 of FIGS. 1-5. The openings 400 can then be formed around each of the first and second inner tabs 330, 332 by removing additional portions of the body 322 adjacent to the first and second inner tabs 330, 332 in a stamping, cutting, or punching process.

Additional, non-limiting embodiments of the present disclosure may include the following aspects, in any combination or sub-combination:

According to a first aspect of the present disclosure, a package for a household appliance includes: a container including a first wall and a second wall, opposite the first wall; a cross-brace assembly, including: a holder having a body including a first side and a second side, opposite the first side; a first inner tab and a second inner tab, spaced from the first inner tab, wherein the first and second inner tabs project from the body, and wherein the first inner tab includes a first aperture and the second inner tab includes a second aperture; a first outer tab projecting from the first side of the body, adjacent to the first inner tab; a second outer tab projecting from the second side of the body, adjacent to the second inner tab; and a brace having opposing first and second ends; wherein the brace is received within the first and second apertures such that the first end of the brace is disposed adjacent the first outer tab and the second end of the brace is disposed adjacent the second outer tab to retain the brace relative to the holder.

According to another aspect of the present disclosure, the first inner tab and the second inner tab are one of cut, stamped, or punched from the body.

According to another aspect of the present disclosure, the holder includes one of cardboard, polymeric material, card stock, paper, corrugated material, or combinations thereof.

According to another aspect of the present disclosure, the brace includes one of aluminum, metal, metal alloy, wood, polymeric material, cardboard, corrugated material, or combinations thereof.

According to another aspect of the present disclosure, the first outer tab includes an outer surface abutting the first wall and the second outer tab includes an outer surface abutting the second wall.

According to another aspect of the present disclosure, the first outer tab includes an inner surface abutting the first end of the brace and the second outer tab includes an inner surface abutting the second end of the brace.

According to another aspect of the present disclosure, the first and second inner tabs and the first and second outer tabs are integrally formed with the body.

According to another aspect of the present disclosure, a cross-brace assembly includes: a holder having a body including a first side and a second side, opposite the first side; a first inner tab and a second inner tab, spaced from the first inner tab, wherein the first and second inner tabs are formed in the body, and wherein the first inner tab includes a first aperture and the second inner tab includes a second aperture; a first outer tab projecting from the first side of the body, adjacent to the first inner tab; and a second outer tab projecting from the second side of the body, adjacent to the second inner tab, and wherein the first and second inner tabs are configured to be moveable into a position in which the first and second inner tabs extend at an angle relative to the body and wherein the first and second apertures are configured to receive a brace therein to retain the brace between the first and second outer tabs.

According to another aspect of the present disclosure, the cross-brace assembly further includes a brace having opposite first and second ends, wherein the brace is received within the first and second apertures such that the first end of the brace is disposed adjacent the first outer tab and the second end of the brace is disposed adjacent the second outer tab.

According to another aspect of the present disclosure, the first inner tab and the second inner tab are one of cut, stamped, or punched from the body.

According to another aspect of the present disclosure, the cross-brace assembly further comprises a first opening formed in the body adjacent to the first inner tab; and a second opening formed in the body adjacent to the second inner tab, and wherein the first and second openings are configured such that when the first inner tab and the second inner tab lie in substantially the same plane as the body, the first opening provides a first gap between the body and at least one edge of the first inner tab, and the second opening provides a second gap between the body and at least one edge of the second inner tab.

According to another aspect of the present disclosure, the holder includes one of cardboard, polymeric material, card stock, paper, corrugated material, or combinations thereof.

According to another aspect of the present disclosure, the brace includes one of aluminum, metal, metal alloy, wood, polymeric material, cardboard, corrugated material, or combinations thereof.

According to another aspect of the present disclosure, the first outer tab includes an inner surface abutting the first end of the brace and the second outer tab includes an inner surface abutting the second end of the brace.

According to another aspect of the present disclosure, the first and second inner tabs and the first and second outer tabs are integrally formed with the body.

According to another aspect of the present disclosure, a method of assembling a cross-brace assembly includes: providing a holder having a body including a first side, spaced from a second side, and a first outer tab extending from the first side and a second outer tab extending from the second side; bending a first inner tab and a second inner tab formed in the body, wherein the first inner tab is spaced from the first outer tab and the second inner tab is spaced from the second outer tab, and wherein the first inner tab includes a first aperture and the second inner tab includes a second aperture; inserting a brace through the first and second apertures, such that a first end of the brace is disposed between the first inner and outer tabs and the second end of the brace is disposed between the second inner and outer tabs; and bending the first outer tab toward the first end of the brace and bending the second outer tab toward the second end of the brace.

According to another aspect of the present disclosure, prior to the bending a first inner tab and a second inner tab, the method further includes: forming the first and second inner tabs by one of cutting, stamping, punching, or combinations thereof the first and second inner tabs from the body.

According to another aspect of the present disclosure, prior to the bending a first inner tab and a second inner tab, the method further includes: forming the first and second inner tabs in the body such that there is a gap between at least one edge of each of the first and second inner tabs and an adjacent portion of the body.

According to another aspect of the present disclosure, prior to the providing a holder, the method further includes: forming one of a crease line or a score line between the first outer tab and the first side and between the second outer tab and the second side.

According to another aspect of the present disclosure, the holder includes one of cardboard, polymeric material, card stock, paper, corrugated material, or combinations thereof.

According to another aspect of the present disclosure, the brace includes one of aluminum, metal, metal alloy, wood, polymeric material, cardboard, corrugated material, or combinations thereof.

According to another aspect of the present disclosure, the first outer tab includes an inner surface abutting the first end of the brace and the second outer tab includes an inner surface abutting the second end of the brace.

According to another aspect of the present disclosure, a method of assembling a household appliance in a package includes: disposing a household appliance within a container including at least a first wall and a second wall, opposite the first wall; and placing the cross-brace assembly within the container, above the household appliance, such that the first outer tab is disposed adjacent to the first wall and the second outer tab is disposed adjacent to the second wall.

Modifications of the disclosure will occur to those skilled in the art and to those who make or use the concepts disclosed herein. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described concepts, and other components, is not limited to any specific material. Other exemplary embodiments of the concepts disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, and the nature or numeral of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise.

To the extent not already described, the different features of the various aspects of the present disclosure may be used in combination with each other as desired. That a particular feature is not explicitly illustrated or described with respect to each aspect of the present disclosure is not meant to be construed that it cannot be, but it is done for the sake of brevity and conciseness of the description. Thus, the various features of the different aspects may be mixed and matched as desired to form new aspects, whether or not the new aspects are expressly disclosed.

What is claimed is:

1. A package for a household appliance, comprising:

a container comprising a first wall and a second wall, opposite the first wall;

a cross-brace assembly, comprising:

a holder having a body comprising a first side and a second side, opposite the first side;

a first inner tab and a second inner tab, spaced from the first inner tab, wherein the first and second inner tabs project from respective first and second openings formed in the body, and wherein the first inner tab comprises a first aperture and the second inner tab comprises a second aperture;

a first outer tab projecting from the first side of the body, adjacent to the first inner tab;

a second outer tab projecting from the second side of the body, adjacent to the second inner tab; and a brace having opposing first and second ends, and wherein the brace is received within the first and second apertures such that the first end of the brace is disposed adjacent the first outer tab and the second end of the brace is disposed adjacent the second outer tab to retain the brace relative to the holder, and wherein the first and second apertures are configured such that when the first inner tab and the second inner tab lie in substantially the same plane as the body, the first aperture provides a first gap between the body and at least one edge of the first inner tab, and the second aperture provides a second gap between the body and at least one edge of the second inner tab.

2. The package of claim 1, wherein the first inner tab and the second inner tab are one of cut, stamped, or punched from the body.

3. The package of claim 1, wherein the holder comprises one of cardboard, polymeric material, card stock, paper, corrugated material, or combinations thereof.

4. The package of claim 1, wherein the brace comprises one of aluminum, metal, metal alloy, wood, polymeric material, cardboard, corrugated material, or combinations thereof.

5. The package of claim 1, wherein the first outer tab comprises an outer surface abutting the first wall and the second outer tab comprises an outer surface abutting the second wall.

6. The package of claim 1, wherein the first outer tab comprises an inner surface abutting the first end of the brace and the second outer tab comprises an inner surface abutting the second end of the brace.

7. The package of claim 1, wherein the first and second inner tabs and the first and second outer tabs are integrally formed with the body.

8. A cross-brace assembly, comprising:

a holder having a body comprising a first side and a second side, opposite the first side;

a first inner tab and a second inner tab, spaced from the first inner tab, wherein the first and second inner tabs are formed in the body, and wherein the first inner tab comprises a first aperture and the second inner tab comprises a second aperture;

a first opening formed in the body adjacent to the first inner tab;

a second opening formed in the body adjacent to the second inner tab;

a first outer tab projecting from the first side of the body, adjacent to the first inner tab; and a second outer tab projecting from the second side of the body, adjacent to the second inner tab, and wherein the first and second inner tabs are configured to be moveable into a position in which the first and second inner tabs extend at an angle relative to the body, and wherein the first and second apertures are configured to receive a brace therein to retain the brace between the first and second outer tabs, and wherein the first and second openings are configured such that when the first inner tab and the second inner tab lie in substantially the same plane as the body, the first opening provides a first gap between the body and at least one edge of the first inner tab, and the second opening provides a second gap between the body and at least one edge of the second inner tab.

9. The cross-brace assembly of claim 8, further comprising:

a brace having opposite first and second ends, and wherein the brace is received within the first and second apertures such that the first end of the brace is disposed adjacent the first outer tab and the second end of the brace is disposed adjacent the second outer tab.

10. The cross-brace assembly of claim 9, wherein the first outer tab comprises an inner surface abutting the first end of the brace and the second outer tab comprises an inner surface abutting the second end of the brace.

11. The cross-brace assembly of claim 8, wherein the first inner tab and the second inner tab are one of cut, stamped, or punched from the body.

12. The cross-brace assembly of claim 8, wherein the first and second inner tabs and the first and second outer tabs are integrally formed with the body.

* * * * *